United States Patent [19]

Landa

[11] Patent Number: 4,883,290

[45] Date of Patent: Nov. 28, 1989

[54] SKI POLE CARRIER

[76] Inventor: Kevin Landa, 769 Georgia Ave., Reading, Pa. 19605

[21] Appl. No.: 311,476

[22] Filed: Feb. 15, 1989

[51] Int. Cl.[4] ..... A63C 11/00

[52] U.S. Cl. ..... 280/814; 24/3 F; 24/329; 24/336; 224/197; 224/247; 224/252; 224/917

[58] Field of Search ..... 280/814, 809, 815, 820; 224/917, 252, 247, 269, 249, 197; 294/147; 24/3 H, 3 F, 326, 329, 336

[56] References Cited

U.S. PATENT DOCUMENTS

| | | | |
|---|---|---|---|
| 3,892,343 | 7/1975 | Warner | 280/814 |
| 3,935,977 | 2/1976 | Bonnett | 280/814 |
| 4,190,182 | 2/1980 | Hickey | 294/147 |
| 4,739,914 | 4/1988 | Pothetes | 224/247 |

*Primary Examiner*—Charles A. Marmor
*Assistant Examiner*—Eric Culbreth
*Attorney, Agent, or Firm*—Leonard M. Quittner

[57] ABSTRACT

A ski pole carrier for carrying ski poles on the person having a clip for attachment to the person, a holder to hold the poles longitudinally, a rotation device to rotate the poles parallel to the person and a bracket to hold poles offset from the person.

8 Claims, 1 Drawing Sheet

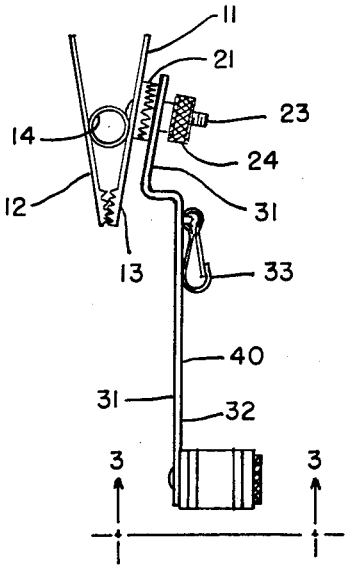
FIG. 2
FIG. 3
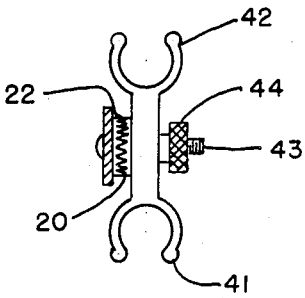
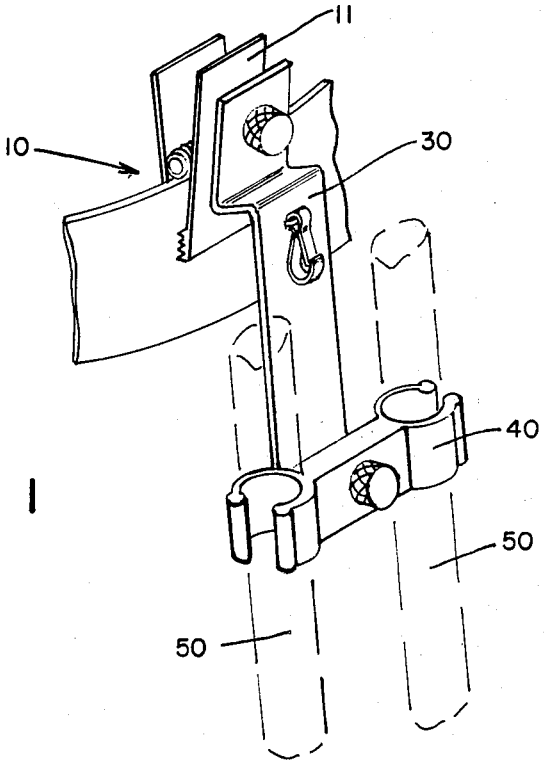
FIG. 1

SKI POLE CARRIER

CROSS-REFERENCES

There are no cross-references to, nor are there any, related applications.

FEDERALLY-SPONSORED RIGHTS

The invention herein was made without any Federal sponsorship or contribution.

BACKGROUND OF THE INVENTION

1. The Field of the Invention.

The field of the invention relates to the portable carriage of ski poles more particularly during activities associated with skiiing.

2. Description of the Prior Art.

Carriers for skis, poles and shoes are known. U.S.L.P. No. 4,190,182 (Feb 1980 to Hickey); 3,935.977 (Feb 1975 to Bonnett); 3,892,343 (July 1975 to Warner). The devices of the art are bulky and function primarily for transport to and from a ski resort or for long term storage. Each addresses the keeping of shoes, skis and poles together, or skis and poles combined. However, such carriers are not useful for carriage in the vicinity of ski slopes, since they are bulky and are subject to theft if left unattended. Loose skis and poses are awkward also.

SUMMARY OF THE INVENTION

The invention described herein is summarized as a hands free ski pole carrier to be worn. It is comprised of a spring clip for attachment to a belt or a back pack; swivel means to adjust the angle at which the poles are carried and holding means to hold the poles centrally on their longitudinal axis. When not used for carriage, the carrier remains attached to the person in a way which does not impede progress during, for example, skiing.

An object of the invention is to provide a light weight, simple means for carrying ski poles wherein the hands are left free.

A further object of the invention is to permit maintenance of possession of the carrier during skiing.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein 3 figures are shown on one sheet. The numbers shown on the drawings for the various parts of the invention are consistent throughout so that a number indicating a part in one drawing will indicate the same part in another drawing.

FIG. 1 shows the invention in a perspective view as it might be worn on a belt.

FIG. 2 shows a side view of the assembled carrier.

FIG. 3 shows a view as seen through broken line 3—3 on FIG. 2.

DESCRIPTION OF THE PREFERRED EMBODIMENT

The preferred embodiment is described as comprising an improved ski pole carrier 10 having spring clip means 11 for attachment to a belt, a back pack or any convenient place upon the clothing. The clip has a first inner, toothed gripping plate 12 and a second outer toothed gripping plate 13 both attached tooth side toward each other articulatingly by a helical spring 14. Centrally disposed on the outer surface of the second plate is attached a bottom member 21 of a two part ratchet washer assembly 20 for engagement with a top member 22 of the member disposed centrally on the underside of a first end 31 of a bracket 30. The ratchet washer assembly is held in ratcheting orientation by a bolt 23 with a knurled locknut 24 for locking the washer and bracket in angular orientation.

The bracket is essentially "Z" shaped, see FIGS. 1 and 2, to provide an offset away from the person wearing the carrier.

Optionally, there maybe attached centrally on the bracket on its upper side 32 additional clip means 33 for affixing the carrier when detached from the person to a ski lift seat during transport.

Disposed on the bracket's second end is a bi-partial holding clamp 40 made of a rigid material having yieldability such as styrene or urethanes. Each part 41, 42 of the clamp is essentially C-shaped and of such a diameter as to hold a ski pole by its shaft snugly. See FIG. 1. An additional bolt 43 and nut 44 maybe disposed on the second end of the bracket to provide rotational adjustment of the clamp. The clamp may optionally be fitted with a ratchet washer or assembly, not shown, for locking.

Since many modifications, variations and changes in detail may be made to the presently described embodiment, it is intended that all matters in the foregoing description and accompanying drawings be interpreted as illustrative and not by way of limitation.

What is claimed is:

1. A carrier for carrying ski poles on the person comprising (a) clip means for attachment to the person;

(b) clamp means for holding a pair of ski poles snugly in the carrier;

(c) rotation means attached to the clamp means to alter rotationally the longitudinal axis of the ski poles relative to the person when held in the carrier;

(d) offset bracket means between the clip means and clamp means for offsetting the poles from the person.

2. A ski pole carrier as in claim 1 wherein the clip means is a pair of toothed plates held tooth side toward each other in clipping engagement by a helical spring.

3. A ski pole carrier as in claim 1 wherein the clamp means is bi-partite, each part of which is a C-shaped member made of a yieldable material and of a diameter sufficient to hold a ski pole snugly.

4. A ski pole carrier as in claim 3 wherein the yieldable material is a plastic chosen from a group comprising styrene, and urethane.

5. A ski pole carrier as in claim 4 wherein the material is urethane.

6. A ski pole carrier as in claim 1 wherein the rotation means is a two part ratchet washer assembly.

7. A ski pole carrier as in claim 1 wherein the offset bracket is Z-shaped.

8. A ski pole carrier as in claim 1 wherein attached to the offset bracket is a clip means to affix the carrier to a ski lift.

* * * * *